United States Patent [19]

Grall

[11] Patent Number: 4,848,833

[45] Date of Patent: Jul. 18, 1989

[54] TABLET ARM ASSEMBLY

[75] Inventor: Terrand B. Grall, Sheboygan Falls, Wis.

[73] Assignee: Consumer Care Products Incorporated, Sheboygan, Wis.

[21] Appl. No.: 185,556

[22] Filed: Apr. 25, 1988

[51] Int. Cl.[4] ..... A47B 39/00

[52] U.S. Cl. ..... 297/162; 297/155; 297/161

[58] Field of Search ..... 297/162, 150, 155, 145, 297/161

[56] References Cited

U.S. PATENT DOCUMENTS

| | | | |
|---|---|---|---|
| 111,858 | 2/1871 | McCausland | 108/28 |
| 1,217,231 | 2/1967 | Soper | 297/150 |
| 1,222,455 | 4/1917 | Packwood | 297/150 X |
| 1,251,303 | 6/1917 | Seligman | 297/145 |
| 1,420,061 | 6/1922 | Rappeline | 108/24 |
| 1,706,233 | 3/1929 | Jackson | 297/161 |
| 2,468,683 | 4/1949 | Michal | 297/155 X |
| 2,664,943 | 1/1954 | Clarin | 297/162 |
| 3,212,814 | 10/1965 | Anderson | 297/162 X |
| 3,265,436 | 8/1966 | Bombard et al. | 297/162 |
| 3,368,842 | 2/1968 | Polsky | 297/162 |
| 3,467,432 | 9/1969 | Sullivan | 297/162 |
| 3,547,488 | 12/1970 | Barnes | 297/162 |
| 3,632,163 | 1/1972 | Burnham | 297/162 |
| 3,968,992 | 7/1976 | Hogan | 297/162 |
| 3,999,798 | 12/1976 | Roulier | 297/150 |
| 4,428,616 | 1/1984 | Hamilton | 297/162 |
| 4,606,576 | 8/1986 | Jones | 108/24 |
| 4,662,676 | 5/1987 | Havelock | 297/160 |
| 4,685,726 | 8/1987 | Wolpert | 297/162 |

FOREIGN PATENT DOCUMENTS

| | | | |
|---|---|---|---|
| 816467 | 7/1969 | Canada | 297/162 |

*Primary Examiner*—Francis K. Zugel

*Attorney, Agent, or Firm*—Lorusso & Loud

[57] ABSTRACT

A tablet arm assembly for mounting on a wheelchair or the like comprises a tablet arm, a telescoping support for mounting the tablet arm on the wheelchair, a pivot mechanism for pivotally connecting the tablet arm to the support to permit the tablet arm to pivot from a horizontal use position to a vertical storage position alongside the wheelchair, and a slide mechanism for slidably connecting the tablet arm to the support to permit the tablet arm to be adjusted in its horizontal use position and slide downward into its vertical storage position. The pivot mechanism comprises a two-way hinge adapted to permit the table arm to be flipped up from its horizontal use position and to pivot downward to its vertical storage position. The two-way hinge is adjustable to permit the tablet arm to pivot downward in either a forward or rearward direction relative to the wheelchair. The tablet arm assembly is suitable for use with various types of wheelchairs and other mobility aids because the tablet arm is collapsible from a horizontal use position to a vertical storage position which avoids interference with the operation of the wheelchair.

11 Claims, 5 Drawing Sheets

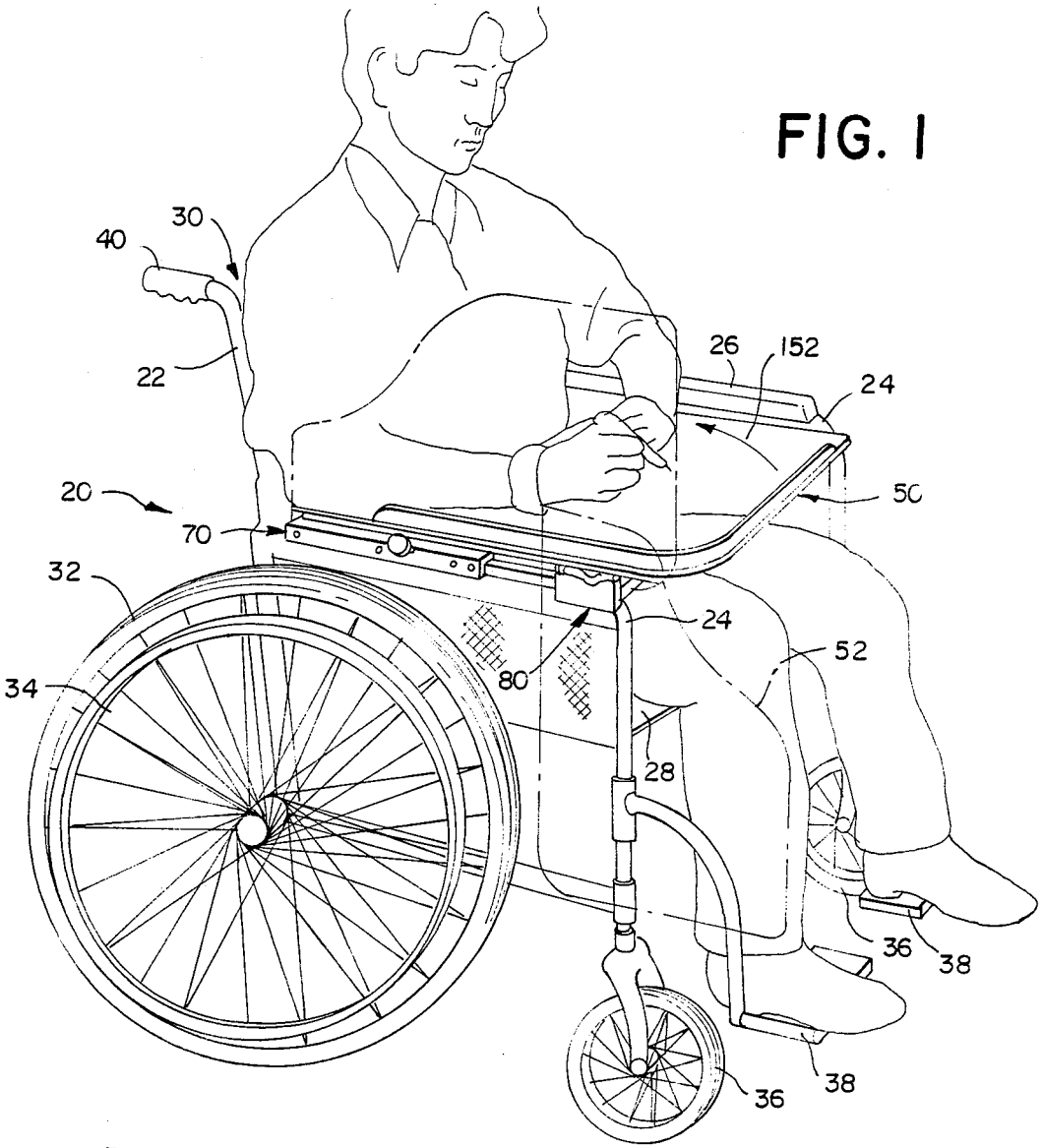
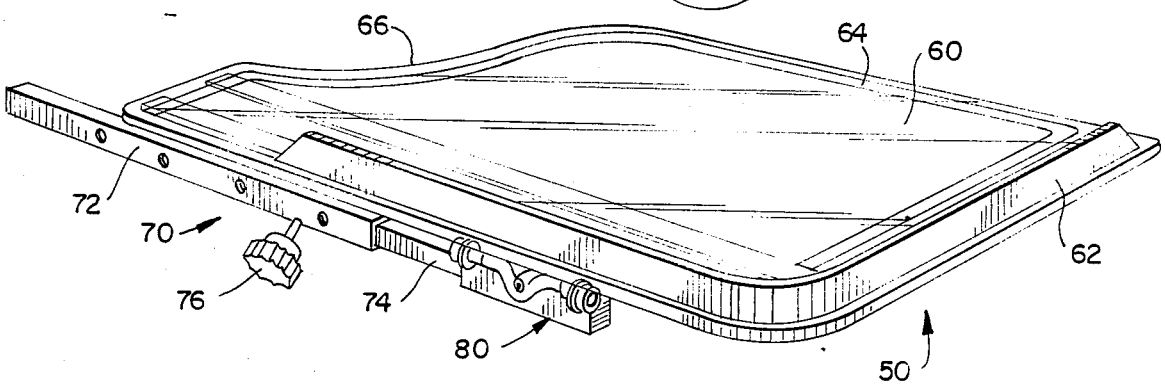
FIG. 2

TABLET ARM ASSEMBLY

FIELD OF THE INVENTION

The present invention relates to a tablet arm assembly for a wheelchair or the like and, more particularly, to a tablet arm assembly adapted to be mounted on the arm of a wheelchair or other mobility aid used by patients or handicapped persons. Specifically, this invention relates to a tablet arm assembly for mounting on the arm of the wheelchair or the like including a tablet arm which is pivotable from a horizontal use position to a vertical storage position alongside the wheelchair. The tablet arm is slidable in its horizontal use position forward and rearward relative to the wheelchair for adjustment of its horizontal use position. The tablet arm is pivotable downward to its vertical storage position in either a forward or rearward direction to avoid interference with the operation of the wheelchair. The invention also relates a tablet arm assembly including a telescoping support member adapted to mount the tablet arm assembly on the arm of a wheelchair and to permit the tablet arm assembly to be easily removed from the wheelchair arm when desired.

BACKGROUND OF THE INVENTION

In the prior art, various types of folding or collapsible tablet and tray assemblies have been designed for use with wheelchairs, invalid chairs, high chairs and classroom chairs. A typical tablet arm or tray assembly includes a table arm or tray which is collapsible from a horizontal use position to a vertical storage position alongside the wheelchair or other type of chair. The tablet arm or tray serves as a desk or work surface in its horizontal use position.

A drawback of the tablet arm and tray assemblies of the prior art is that such an assembly has been limited in use only to the particular type of chair for which it was designed. For example, the collapsible tablet arm assemblies for wheelchairs have not been readily adaptable for use with invalid chairs or motorized three-wheeled scooters. Also, the collapsible tablet arm assemblies designed for high chairs and classroom chairs have not been readily adaptable for use with wheelchairs and other mobile aids for patients or handicapped persons.

Wheelchairs usually include a large pair of rear drive wheels which are manually turned by the person seated in the wheelchair or driven by a motor mounted on the wheelchair. To be adaptable for use with such wheelchairs, a tablet arm or tray assembly must avoid interference with the operation of the wheelchair when collapsed into its storage position.

In the case of a manually operated wheelchair, a collapsible tablet arm assembly must not interfere with the ability of the person sitting in the wheelchair to operate the large rear drive wheels when the tablet arm assembly is moved to its vertical storage position. Similarly, in the case of a motorized or power wheelchair, the collapsible tablet arm assembly must not interfere with the ability of the person sitting in the wheelchair to operate the wheelchair power controls when the tablet arm assembly is moved to its vertical storage position. Also, in the case of three-wheel power scooters, the collapsible tablet arm assembly must not interfere with the steering handle or tiller when the tablet arm assembly is placed its vertical storage position. Thus, it is desirable to provide a collapsible tablet arm assembly which is conveniently usable with all types of mobile aids including manual wheelchairs, power wheelchairs, and three-wheel scooters.

SUMMARY OF THE INVENTION

The present invention provides a collapsible tablet arm assembly which is advantageously usable with all types of mobility aids, including manual wheelchairs, power wheelchairs, and three-wheel power scooters. The collapsible tablet arm assembly is designed to assume a vertical storage position alongside the wheelchair or other mobility aid which avoids interference with the operation of the wheelchair or mobility aid. The tablet arm assembly is also designed to be conveniently adjusted in position to adapt it for use with various types of wheelchairs and mobility aids.

In accordance with the present invention, a tablet arm assembly for mounting on a wheelchair or the like comprises a tablet arm, a support for mounting the tablet arm on the wheelchair, first means for pivotally connecting the tablet arm to the support to permit the tablet arm to pivot from a horizontal use position to a vertical storage position alongside the wheelchair, and second means for slidably connecting the tablet arm to the support to permit the tablet arm to be adjusted in its horizontal use position and to slide downward into its vertical storage position. Preferably, the first means comprises a pivot mechanism adapted to permit the tablet arm to be flipped up from its horizontal use position and to pivot downward to its vertical storage position. The pivot mechanism is adjustable to permit the tablet arm to pivot downward in either a forward or rearward storage position relative to the wheelchair to avoid interference with its operation. Preferably, the second means comprises a slide mechanism for slidably connecting the tablet arm to the support to permit the tablet arm in its horizontal use position to slide horizontally relative to the wheelchair and in its vertical storage position to slide vertically relative to the wheelchair. The tablet arm is detachably connected to the slide mechanism to allow removal and replacement of the tablet arm. The preferred embodiment also includes a telescoping support member for adjusting the position of the tablet arm assembly on the wheelchair.

A preferred embodiment of the tablet arm assembly incorporates a pivot mechanism for pivotally connecting the tablet arm to the support and a slide mechanism for connecting the tablet arm to the pivot mechanism. The pivot mechanism is adapted to allow the tablet arm to pivot about first and second orthogonally oriented pivot axes from a horizontal use position to a vertical storage position alongside the wheelchair. The slide mechanism permits the tablet arm in its horizontal use position to slide horizontally relative to the wheelchair in a direction parallel to one of the orthogonally oriented pivot axes and permits the tablet arm in its vertical storage position to slide vertically relative to the wheelchair. The pivot mechanism is adjustable to permit the tablet arm to pivot either forward or rearward about the other orthogonally oriented pivot axis relative to the wheelchair. Preferably, the slide mechanism includes a track extending longitudinally along the tablet arm, and the pivot mechanism includes a pivotal hinge plate slidably received in the track to permit the tablet arm to slide relative to the hinge plate. The hinge plate is mounted for pivotal about each of the orthogonally oriented axes to provide a two-way hinge which permits the tablet arm to pivot between its horizontal use position and its vertical storage position.

The invention also contemplates a tablet arm assembly which is designed to be mounted on the arm of a wheelchair or other mobility aid. The tablet arm assembly includes a tablet arm and a support for mounting the tablet arm on the arm of the wheelchair. A pivot mechanism is provided for pivotally connecting the tablet arm to the support to permit the tablet arm to pivot about a horizontal axis extending along the arm of the wheelchair from a horizontal use position to a vertical orientation and to permit the tablet arm in its vertical orientation to be rotated about a transverse axis into a vertical storage position alongside the wheelchair. Preferably, the pivot mechanism is adapted to permit the tablet arm in its vertical orientation to rotate either clockwise or counterclockwise about the transverse axis into its vertical storage position. Preferably, an adjustable stop is provided for limiting the rotation of the tablet arm about the transverse axis to 90° in either a clockwise or counterclockwise direction. In addition, a slide mechanism is provided for slidably connecting the tablet arm to the pivot mechanism to permit the tablet arm in its horizontal use position to slide horizontally forward and rearward along the arm of the wheelchair and in its vertical storage position to slide vertically relative to the wheelchair.

The present invention achieves a collapsible tablet arm assembly which is conveniently movable from a horizontal use position to a vertical storage position alongside the wheelchair. The slide mechanism allows the tablet arm assembly to be adjusted in its horizontal use position and allows the tablet arm to slide downward relative to the wheelchair to its vertical storage position. The pivot mechanism allows the tablet arm to flip up and to pivot either forward or rearward relative to the wheelchair to a vertical storage position which avoids interference with the operation of the wheelchair. Because of its versatility, the tablet arm assembly is readily usable with all types of wheelchairs and mobility aids.

BRIEF DESCRIPTION OF THE DRAWINGS

FIG. 1 is a perspective view of a wheelchair with a collapsible tablet arm assembly constructed in accordance with the present invention;

FIG. 2 is an enlarged perspective view of the tablet arm assembly of the present invention;

DETAILED DESCRIPTION OF PREFERRED EMBODIMENT

Figure 3:
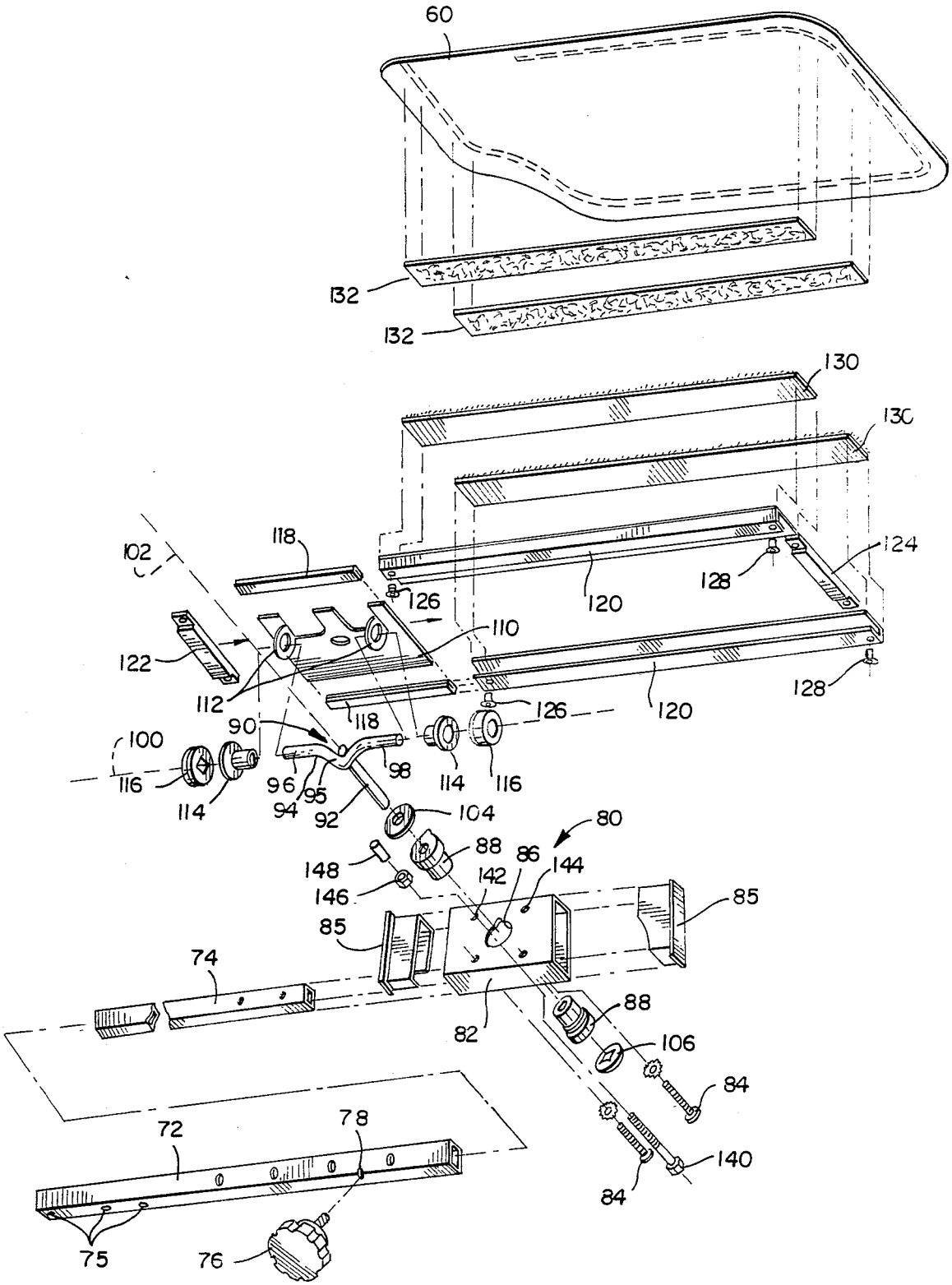
FIG. 3 is an exploded perspective view of the tablet arm assembly of FIG. 2.

Referring to FIG. 1, a conventional manual wheelchair 20 comprises a tubular metal frame 22 having a pair of arms 24 each provided with an armrest 26, a seat 28 and a back 30. The wheelchair includes a pair of drive wheels 32 (one shown) each provided with a handring 34 which can be used by a person seated in the wheelchair for propulsion. A pair of smaller, steerable wheels 36 and a pair of footrests 38 are provided at the front of the wheelchair. A pair of manually engageable handles 40 is provided on the wheelchair frame 22 which can be used by an attendant to propel the wheelchair.

A tablet arm assembly, generally 50, constructed in accordance with the present invention, is mounted on one of the arms of the wheelchair. It will be understood by persons skilled in the art that tablet arm assembly 50 may be constructed in a right-handed or left-handed embodiment for mounting on either of the wheelchair arms. FIG. 1 illustrates the tablet arm assembly arranged in a horizontal use position on the wheelchair. The tablet arm assembly 50 is collapsible to a forward storage position (indicated by phantom lines 52) or to a rearward storage position depending upon the type of wheelchair on which the tablet arm assembly is installed. For example, in the case of a manual wheelchair, it is preferable to store the tablet arm assembly 50 in its forward storage position 52 to permit easy access to the handrings by the person seated in the wheelchair. On the other hand, in the case of a power wheelchair with its controls (not shown) mounted at the front of the wheelchair arm, it is preferable to store the tablet arm assembly 50 in its rearward storage position to allow easy access to the power controls by the person seated in the chair. Also, in the case of a three-wheel power scooter provided with a steering tiller, it is desirable to store the tablet arm assembly 50 in its rearward storage position to avoid interference with the steering tiller of the scooter. Thus, it is contemplated that the tablet arm assembly of the present invention may be employed with both manual and power wheelchairs and other types of mobility aids including three-wheel scooters.

As shown in FIG. 2, tablet arm assembly 50 includes a flat tablet arm or tray 60 which serves as a desk or work surface. Tablet arm 60 preferably consists of transparent material, e.g., a clear polycarbonate. A rim 62 is press fitted and fused into an elongated slot formed in tablet arm 60. A pencil or spill trough 64 runs along the front and inner edges of tablet arm 60 which also includes a stomach cut-out portion 66.

Tablet arm assembly 50 includes a telescoping support arm, generally 70, comprising first elongated support tube 72 which slidably receives a second elongated support tube 74. Preferably, the support tubes 72 and 74 are square in cross section. Support tube 72 includes a set of mounting holes 75 formed in its lower wall. A control knob 76 is threadably mounted in an opening 78 in support tube 72 to enable the telescoping support arm 70 to be adjusted in length and to lock support tubes 72 and 74 together at a desired length.

A pivot mechanism, generally 80, is supported by telescoping support arm 70. Pivot mechanism 80 includes a tubular, rectangular metal housing 82 which is attached to support tube 74 by a pair of machine screws 84. A pair of plastic end caps 85 are mounted at opposite ends of the tubular, rectangular housing 82 which serves as a support for a two-way hinge described below. Housing 82 includes a pair of aligned openings 86 formed in its opposite sides which receive a pair of plastic bushings 88.

To provide a two-way hinge, a T-shaped connector, generally 90, includes a straight shaft 92 welded or otherwise secured to a shaft 94 which is bent or offset at its central portion 95 to accommodate shaft 92. Bent shaft 94 includes a pair of aligned straight portions 96 and 98 on opposite sides of its central offset portion 95. As shown in FIG. 3, the T-shaped connector 90 defines a pair of orthogonally oriented, non-intersecting pivot axes, i.e., a first axis 100 extending along the straight portions 96 and 98 of shaft 94 and a second axis 102 extending along straight shaft 92. Preferably, each of the pivot axes 100 and 102 is oriented at right angles to a vertical plane including the other axis, and pivot axis 100 of shaft portions 96 and 98 is displaced above pivot axis 102 of shaft 92. The shaft 92 extends through a nylon washer 104 into bushings 88 which together with housing 82 support shaft 92 of T-shaped connector 90 for rotation about axis 102. A metal locking cap 106 is secured to the free end of shaft 92 to retain the shaft within bushings 88. A countersunk washer 107 is secured by a rivet 108 to the other end of shaft 92.

To complete the two-way hinge, a hinge plate 110 is pivotally connected to shaft 94 of T-shaped connector 90. Hinge plate 110 includes a pair of depending flanges 112 provided with circular openings for receiving a pair of nylon bushings 114 which rotatably receive the straight portions 96 and 98 of shaft 94. A pair of metal locking caps 116 are fastened to the opposite ends of shaft 94 to hold the shaft 96, bushings 114 and flanges 112 of hinge plate 110 together. As a result, hinge plate 110 is pivotally supported by shaft 94 for rotation about axis 100. In turn, hinge plate 110 and shaft 94 are both mounted on shaft 92 for rotation about axis 102. Thus, hinge plate 110, T-shaped connector 90 and housing 82 comprise a two-way hinge which allows hinge plate 110 to pivot about each of the axes 100 and 102.

Figure 4:
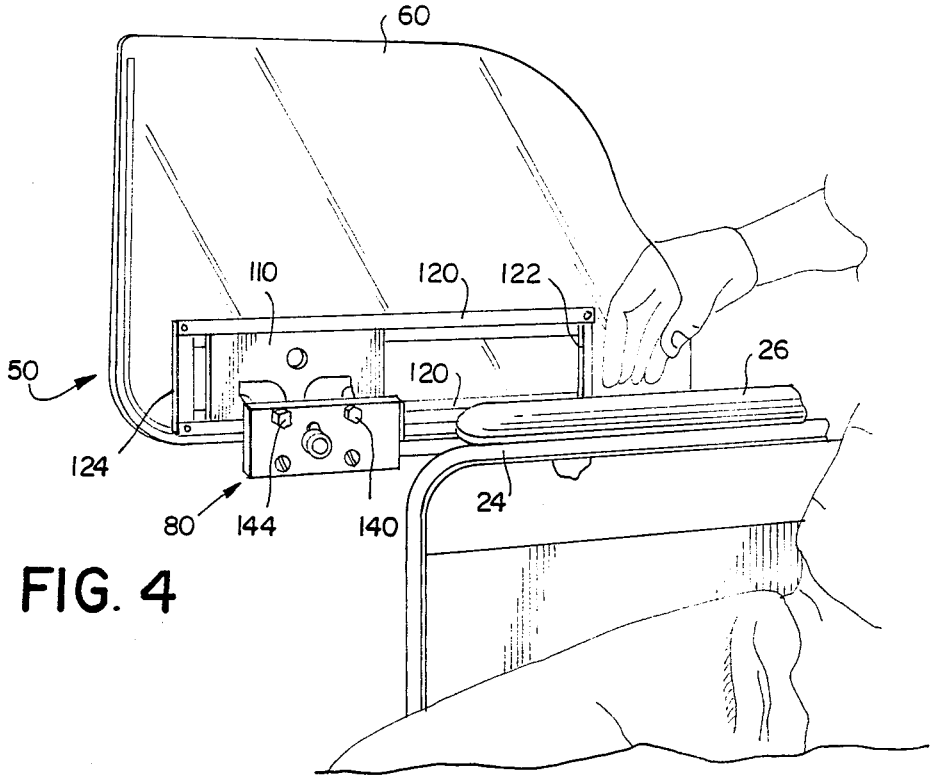
FIG. 4 is an enlarged perspective view of the tablet arm assembly flipped up to a vertical orientation on the arm of the wheelchair.

Tablet arm assembly 50 includes a slide mechanism comprising a pair of elongated track members 120 attached to the underside of tablet arm 60 which slidably receive hinge plate 110 to allow tablet arm 60 to slide relative to pivot mechanism 80. Track members 120 are elongated, channel-shaped members which are arranged in a spaced, parallel configuration and extend longitudinally along the bottom of tablet arm 60. As shown in FIGS. 3 and 4, track members 120 are spaced apart to define a track in which hinge plate 110 is slidably received. To slidably mount hinge plate 110 on track members 120, a pair of elongated channel-shaped nylon glides 118 are fitted along the opposite edges of hinge plate 110 which are slidably received by track members 120. The sliding movement of hinge plate 110 along track members 120 is limited by a pair of connectors or stop members 122 and 24 which extend across the opposite ends of track members 120. Stop members 122 and 124 are secured to track members 120 by rivets 126 and 128 or other suitable fasteners. Each track member 120 is fastened by adhesive to a strip 130 of POLYLOCK TM plastic fastener tape. Similar strips 132 of POLYLOCK TM plastic fastener tape are secured by adhesive to the underside of tablet arm 60. The strips 130 and 132 of plastic fastener tape include numerous plastic prongs which interlock when strips 130 and 132 are pressed together to secure track members 120 to the underside of tablet arm 60. As a result, tablet arm 60 is detachably connected to track members 120 for removal and replacement of the tablet arm and to allow fine adjustment of its position.

Referring to FIG. 1, tablet arm assembly 50 is mounted on wheelchair 20 by fastening the telescoping support arm 70 in a horizontal orientation along one of the wheelchair arms 24. The telescoping support arm 70 is secured to the wheelchair arm 24 by brackets or other suitable fasteners described in more detail below. The support tubes 72 and 74 of the telescoping support arm 70 permit adjustment of the position of the entire tablet arm assembly 50 on the wheelchair 20. Control knob 78 permits the support tubes 72 and 74 to be unlocked for adjustment and to be locked together at a desired length.

With tablet arm 60 in its horizontal use position (FIGS. 1 and 2), the pivot axis 100 defined by straight portions 96 and 98 of bent shaft 94 extends horizontally along the wheelchair arm 24, while the pivot axis defined by straight shaft 92 extends transversely across the front of the wheelchair. The horizontal use position of tablet arm 60 can be adjusted by sliding the tablet arm 60 and the track members 120 relative to hinge plate 110 of the pivot mechanism 80. The hinge plate 110 and track members 120 also permit the tablet arm 60 to slide downward to its vertical storage position alongside the wheelchair 20.

Preferably, pivot mechanism 80 is adjustable to permit T-shaped connector 90 which supports hinge plate 110 and tablet arm 60 to pivot either forward or rearward relative to the wheelchair about transverse axis 102 defined by shaft 92. Pivot mechanism 80 includes an adjustable stop comprising a bolt 140 which is insertable selectively into either a first pair of aligned holes 142 or a second pair aligned holes 144 formed in opposite sides of housing 82. Bolt 140 is secured in place by a lock nut 146. A plastic cap 148 is fitted on the end of bolt 140 which is positioned to engage straight portions 96 and 98 of shaft 94 to limit T-shaped connector 90 to rotation either clockwise or counterclockwise by 90° about transverse axis 102 defined by shaft 92.

Figure 5:
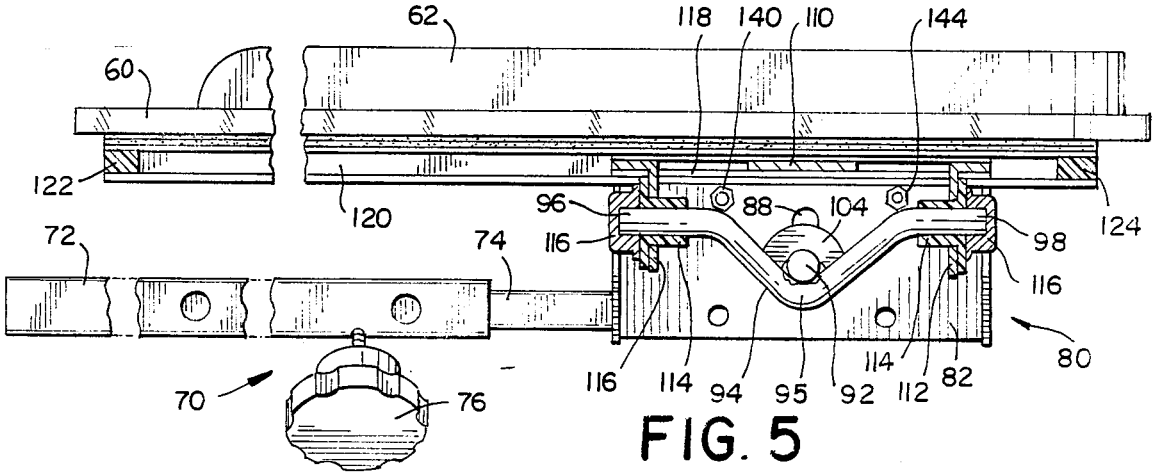
FIG. 5 is a side elevation of the tablet arm assembly showing a two-way pivot and slide mechanism partially in section.
Figure 6:
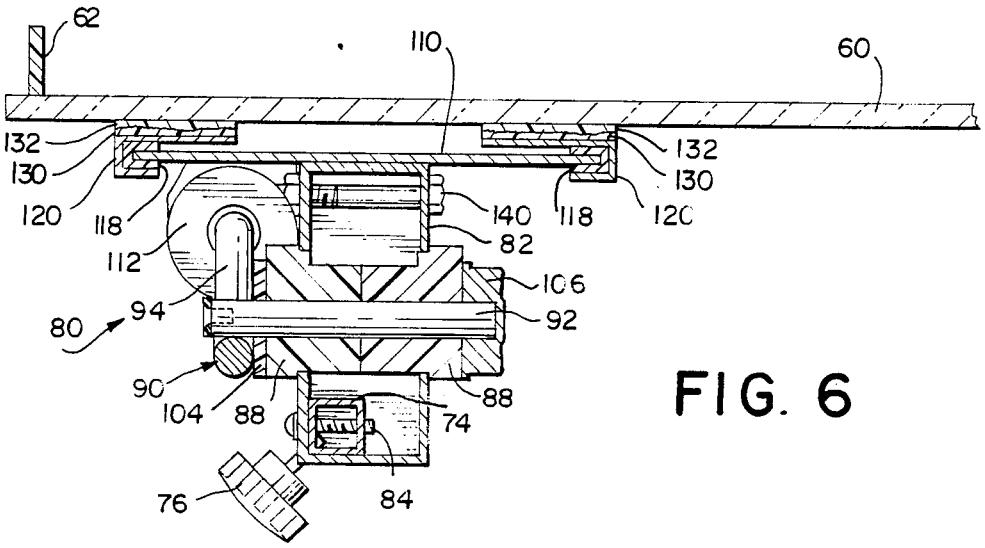
FIG. 6 is a front elevation of the tablet arm assembly showing the two-way pivot and slide mechanism partially in section.

Referring to FIGS. 3 and 5, with adjustable stop bolt 140 inserted in openings 142 located to the left of shaft 92, stop bolt 140 engages the lefthand portion 96 of bent shaft 94 to orient its axis 100 parallel to telescoping support arm 70, i.e., extending horizontally along the arm of the wheelchair. Thus, tablet arm 60 is retained in its horizontal use position by the engagement of bolt 140 with the lefthand portion 96 of bent shaft 94. As shown in FIG. 6, with tablet arm 60 in its horizontal use position, hinge plate 110 rests on the top of housing 82 of pivot mechanism 80.

Figure 7:
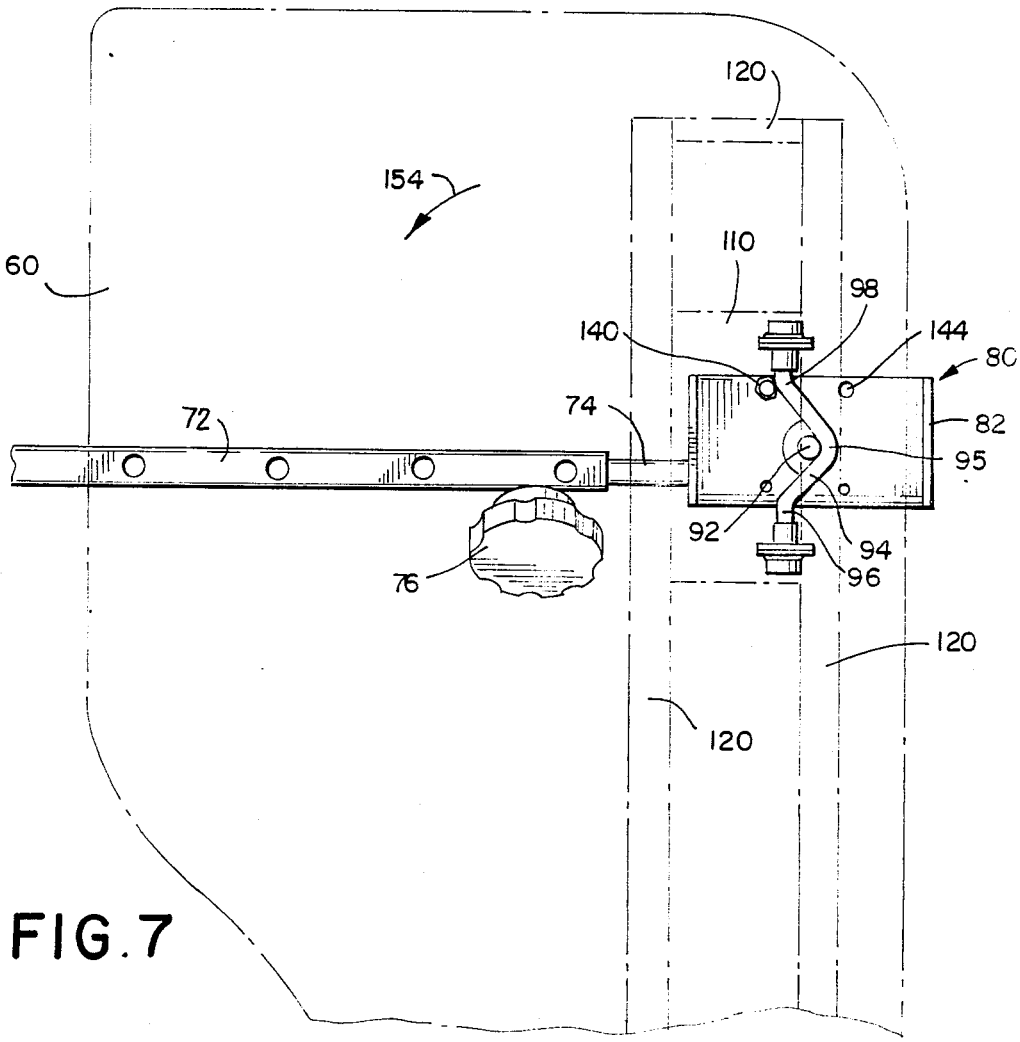
FIG. 7 is a side elevation showing the tablet arm assembly in its storage position.

To collapse tablet arm assembly 50 into its rearward vertical storage position, tablet arm 60 is flipped upward, as indicated by arrow 152 (FIG. 1) to pivot hinge plate 110 about shaft 94 to move tablet arm 60 into a vertical orientation (FIG. 4). Then, tablet arm 60 in its vertical orientation together with hinge plate 110 is pivoted rearward as indicated by arrow 154 (FIG. 7) about shaft 92. Also, hinge plate 110 and track members 120 allow tablet arm 60 to slide downward relative to the wheelchair until stop member 122 engages hinge plate 110. Thus, tablet arm 60 is positioned in a vertical storage position alongside the wheelchair. The stop bolt 140 (FIG. 7) engages the righthand portion 98 of bent shaft 94 to limit the rotation of tablet arm 60 and hinge plate 110 to 90° about shaft 92 and to retain tablet arm 60 in its rearward vertical storage position. Nylon washer 107 (FIG. 6) engages the outermost track member 120 to allow a smooth gliding action therebetween.

To return the tablet arm assembly from its rearward storage position to its horizontal use position, the procedure is reversed. Tablet arm 60 in its rearward vertical storage position is pivoted clockwise about shaft 92 until the lefthand portion 96 of shaft 94 engages stop bolt 140 (FIG. 5). Then, tablet arm 60 is turned downward to its horizontal use position by rotating tablet arm 60 and hinge plate 110 by 90° about shaft 94 until hinge plate 110 engages the top of housing 82 (FIG. 6). Thereafter, tablet arm 60 can be adjusted horizontally along the arm of the wheelchair by sliding tablet arm 60 and track members 120 relative to hinge plate 110.

Figure 8:
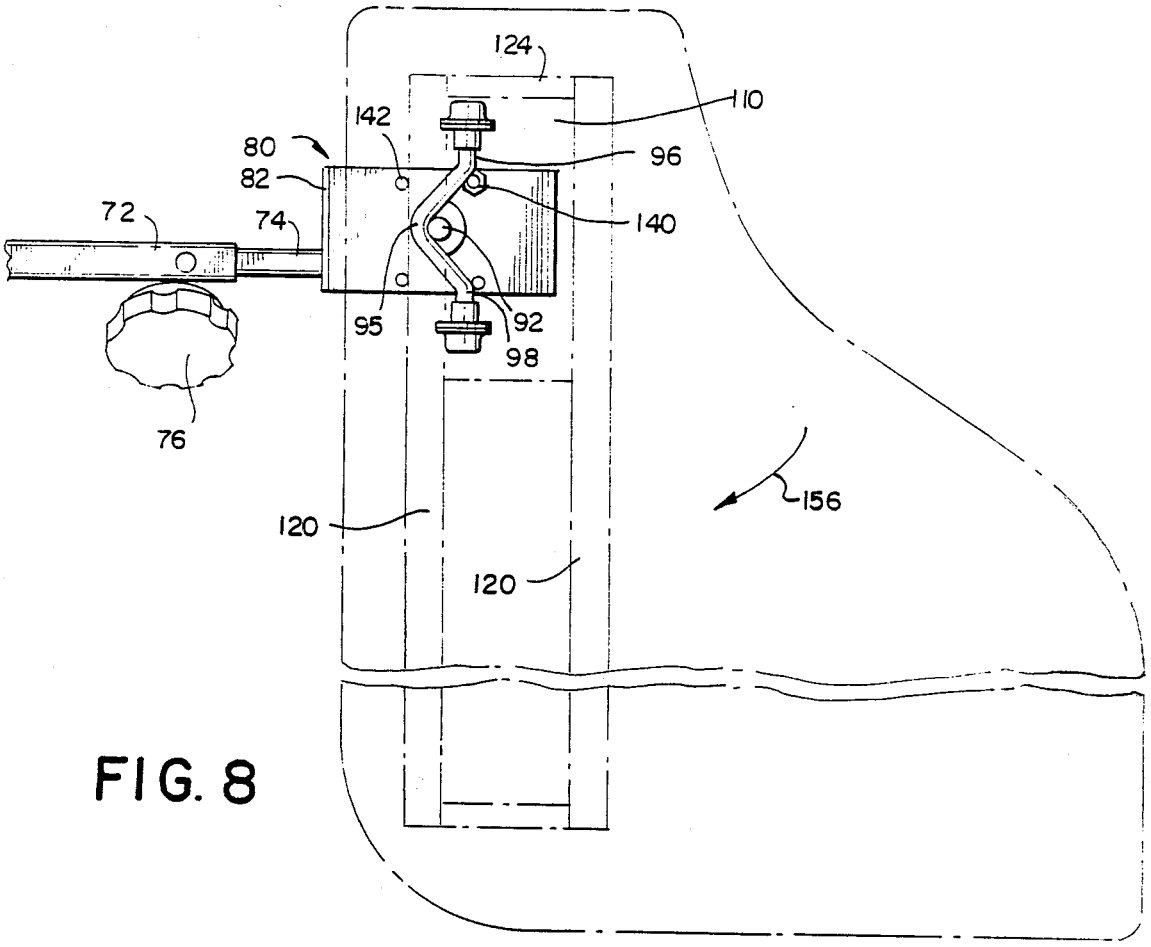
FIG. 8 is a side elevation showing the tablet arm assembly in its rearward storage position.

To allow the tablet arm assembly 50 to pivot forwardly relative to the wheelchair into its forward vertical storage position, adjustable stop bolt 140 is placed in holes 144 (FIG. 5) located to the right of shaft 92. With tablet arm 60 in its horizontal use position, stop bolt 144 engages the righthand portion 98 of bent shaft 94 to prevent counterclockwise rotation about shaft 92 and to retain tablet arm 60 in its horizontal use position. To collapse the tablet arm assembly to its vertical storage position, tablet arm 60 is flipped up into its vertical orientation, and tablet arm 60 and hinge plate 110 are pivoted clockwise as indicated by arrow 156 (FIG. 8) until stop bolt 140 engages the lefthand portion 96 of shaft 94. Thus, stop bolt 140 limits the clockwise rotation of tablet arm 60 and hinge plate 110 to 90° about shaft 92 and retains the tablet arm in its vertical storage position alongside the wheelchair. Track members 120 and hinge plate 110 allow tablet arm 60 to slide downward until stop member 124 engages hinge plate 110 to locate tablet arm 60 in its forward vertical storage position.

To return the tablet arm assembly from its forward vertical storage position to its horizontal use position, the procedure is reversed. Tablet arm 60 is pivoted counterclockwise by 90° about shaft 92 to locate tablet arm 60 in its vertical orientation. Then, tablet arm 60 is turned downward from its vertical orientation to its horizontal use position by rotating tablet arm 60 and hinge plate 110 by 90° about shaft 94 until hinge plate 110 engages the top of housing 82. Thereafter, the tablet arm assembly can be adjusted horizontally relative to the wheelchair by sliding tablet arm 60 and track members 120 relative to hinge plate 110.

Figure 9:
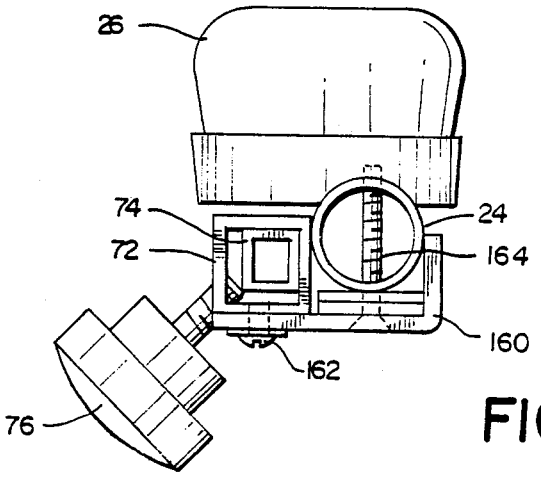
FIG. 9 is a front view, partially in section, illustrating the attachment of the tablet arm assembly to the arm of a manual wheelchair.

Referring to FIG. 9, the tablet arm assembly can be mounted underneath the armrest 26 of a manual wheelchair by a pair of brackets 160 (one shown) each including a screw 162 which extend through the bracket into one of the holes 75 (FIG. 4) provided in outer support tube 72 of telescoping support arm 70. Each bracket 160 is attached to the wheelchair arm 24 by an elongated screw 164 which is also used to secure the armrest 26 to the wheelchair arm.

Figure 10:
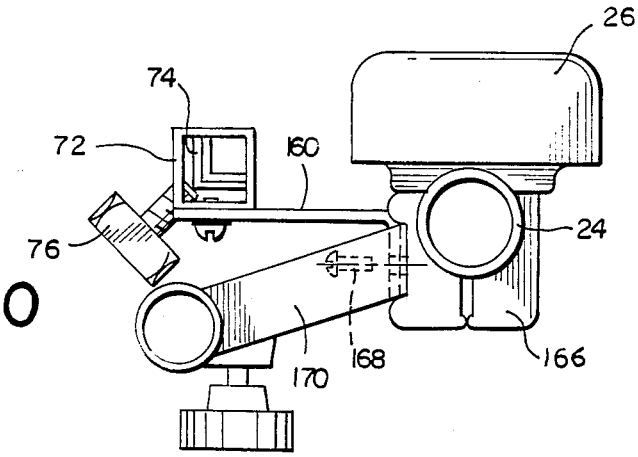
FIG. 10 is a front view, partially in section, illustrating the attachment of the tablet arm assembly to the arm of a power wheelchair.

Referring to FIG. 10, the tablet arm assembly can be fastened to the arm of a power wheelchair by the same L-shaped brackets 160. Each bracket 160 is secured to telescoping support arm 70 by screws 162 which extend through the bracket into one of the holes 75 (FIG. 4) formed in outer support tube 72. Each bracket 160 is secured to a mounting block 166 on wheelchair arm 24 by a screw 168 which is also used to secure a power control box support 170 to the mounting block 166.

Although the preferred embodiment has been described above in the context of a tablet arm assembly for a wheelchair, it will be understood by persons skilled in the art that the invention is applicable to other types of mobility aids such as three-wheel power scooters. In addition, it is contemplated that the tablet arm assembly of the present invention may be advantageously used with other types of chairs which may be stationary or mobile.

The invention in its broader aspects is not limited to the specific details shown and described, and modifications may be made in the tablet arm assembly disclosed above without departing from the principles of the present invention.

I claim:

1. A tablet tray assembly for mounting on a wheelchair or the like having an upright back, comprising:
- a tablet tray;
- a support for mounting said tablet tray on said wheelchair;
- a pivot mechanism mounted on said support and comprising:
- horizontal support means for supporting said tray in a horizontal plane use position;
- first pivot means for pivoting said tablet tray about a first axis from said horizontal plane use position into a first position in a vertical plane;
- second pivot means for pivoting said first axis about a horizontal second axis perpendicular to said vertical plane;
- said second pivot means being adapted to permit said tablet tray to rotate in said vertical plane either clockwise or counterclockwise about said second axis; and
- slide means connecting said pivot mechanism to said tablet tray for sliding said tablet tray, relative to said pivot mechanism, in said horizontal plane, toward or away from the plane of the back of the wheelchair and vertically between a second position in said vertical plane, 90° from said first position, and a storage position alongside the wheelchair, said slide means comprising a slide fixed to said pivot mechanism and track means mounted on the lower surface of said tray to engage said slide for said sliding of said tablet tray relative to said pivot mechanism;
- said pivot mechanism including stop means for restricting the pivoting motion of said first axis to 90° about said second axis, said stop means being adjustable to allow said tablet tray to rotate in said vertical plane either clockwise by 90° or counterclockwise by 90° into said storage position.

2. The tablet tray of claim 1 wherein said slide is a polygonal plate whereby said slide means prevents said tablet tray from rotating in said horizontal plane.

3. A tablet tray assembly for mounting on a wheelchair or the like having an upright back, comprising:
- a tablet tray;
- a support for mounting said tablet tray on said wheelchair;
- a pivot mechanism mounted on said support and comprising:
  - first pivot means for pivoting said tablet tray about a first axis from a horizontal plane use position into a vertical plane;

second pivot means for pivoting said first axis about a horizontal second axis to permit said tablet tray to be rotated in said vertical plane to a vertical storage position alongside the wheelchair, said second axis being perpendicular to said vertical plane;

said second pivot means being adapted to permit said tablet tray to rotate in said vertical plane either clockwise or counterclockwise about said second axis to said storage position; and slide means for connecting said pivot mechanism to said tablet tray for sliding said tablet tray, relative to said pivot mechanism, in said horizontal plane use position, toward or away from the plane of the back of the wheelchair;

said pivot mechanism including stop means for restricting the pivoting motion of said first axis to 90° about said second axis, said stop means being adjustable to allow said tablet tray to rotate in said vertical plane either clockwise by 90° or counterclockwise by 90° into said storage position.

4. The tablet tray assembly of claim 3, wherein:

said slide means includes a track extending longitudinally along said tablet tray; and said pivot mechanism includes a pivotal hinge plate slidably received in said track to permit said tablet arm to slide relative to said hinge plate.

5. The tablet assembly of claim 4, wherein:

said tablet tray is detachably connected to said track for removal and replacement of said tablet tray.

6. The tablet tray assembly of claim 3 wherein said pivot mechanism comprises:

a two-way hinge including a T-shaped connector mounted for pivotal movement about said first axis and a hinge plate attached to said tablet tray and mounted on said T-shaped connector for pivotal movement about said horizontal second axis.

7. The tablet tray assembly of claim 6, wherein said T-shaped connector comprises:

a pair of shafts secured together to define said first and second axis as a pair of orthogonally oriented, non intersecting axes, each of said axes being oriented at right angles to a vertical plane including the other axis, said shaft defining said second axis being secured at one end to said support and secured at its opposite end to the midsection of said shaft defining said first axis.

8. The tablet tray assembly of claim 7 wherein said midsection of said shaft defining said first axis is bowed.

9. The tablet tray assembly of claim 8 wherein said opposite end is welded directly to said midsection.

10. The tablet tray assembly of claim 3 wherein the top of said pivot mechanism comprises a support surface horizontally spaced from said first axis for supporting said tablet tray in said horizontal use position.

11. A tablet tray assembly for mounting on a wheelchair or the like having an upper back, comprising:

a tablet tray;

a support for mounting said tablet tray on the wheelchair;

a pivot mechanism mounted on said support and comprising:

first pivot means for pivoting said tablet tray about a first axis from a horizontal plane use position into a vertical plane; and second pivot means pivoting said first axis in said vertical plane about a horizontal second axis to permit said tablet to be rotated in said vertical plane to a storage position alongside the wheelchair, said second axis being perpendicular to said vertical plane;

slide means connecting said pivot mechanism to said tablet tray for sliding said tablet tray, relative to said pivot mechanism, in said horizontal plane, toward or away from the plane of the back of the wheelchair; and a telescoping arm for adjusting the position of said tablet arm assembly on said wheelchair, said pivot means being mounted on one end of said telescoping arm.

* * * * *